US007637079B2

(12) United States Patent
Klingel et al.

(10) Patent No.: US 7,637,079 B2
(45) Date of Patent: Dec. 29, 2009

(54) INSTALLATION FOR FILLING PACKAGING UNITS WITH MEDICAMENTS FOR PATIENTS ACCORDING TO THE PRESCRIBED WEEKLY REQUIREMENTS

(75) Inventors: Hans Klingel, Möglingen (DE); Edwin Kohl, Merzig (DE)

(73) Assignee: Edwin Kohl, Merzig (DE)

( * ) Notice: Subject to any disclaimer, the term of this patent is extended or adjusted under 35 U.S.C. 154(b) by 74 days.

(21) Appl. No.: 11/568,303

(22) PCT Filed: Jan. 3, 2005

(86) PCT No.: PCT/EP2005/000002

§ 371 (c)(1),
(2), (4) Date: Oct. 8, 2007

(87) PCT Pub. No.: WO2005/102841

PCT Pub. Date: Nov. 3, 2005

(65) Prior Publication Data

US 2008/0190076 A1 Aug. 14, 2008

(30) Foreign Application Priority Data

Apr. 26, 2004 (DE) ..... 10 2004 020 510

(51) Int. Cl.
*B65B 57/00* (2006.01)
*B65B 57/10* (2006.01)
*B65B 5/10* (2006.01)
*B65B 35/30* (2006.01)

(52) U.S. Cl. ..... 53/55; 53/131.2; 53/154; 53/539; 53/543; 53/561; 53/237; 53/240; 53/246; 53/248; 53/251; 53/252; 53/381.1; 53/381.2

(58) Field of Classification Search ..... 53/237, 53/238, 240, 246, 248, 250–252, 131.2, 131.3, 53/55–58, 154, 155, 539, 543, 381.1, 381.2, 53/559, 561
See application file for complete search history.

(56) References Cited

U.S. PATENT DOCUMENTS 2,339,115 A * 1/1944 Scherer ..... 53/539
4,655,026 A * 4/1987 Wigoda ..... 53/55
6,318,051 B1 11/2001 Preiss (Continued)

FOREIGN PATENT DOCUMENTS

DE 2239344 2/1974

(Continued)

*Primary Examiner*—Stephen F Gerrity
(74) *Attorney, Agent, or Firm*—Marger Johnson & McCollom, P.C.

(57) ABSTRACT

An installation for filling weekly blister packs, i.e. packaging units, with doses of different medicaments corresponding to the weekly requirements of several patients and to be taken by the respective patient in a certain order according to the day of the week and the time of the day, according to a doctor's prescription. The installation is provided with output stations associated with the medicaments, for automatically filling all or selected compartments line-by-line. In order to control the output stations in such a way as to fill the weekly blister pack with the prescribed medicament, an electronic control unit processes information about patients, the information being continuously supplied to the unit in such a way that it is synchronized with the blister pack advancing movements.

34 Claims, 8 Drawing Sheets

U.S. PATENT DOCUMENTS 6,449,921 B1 9/2002 Kim

FOREIGN PATENT DOCUMENTS

Figure 1:
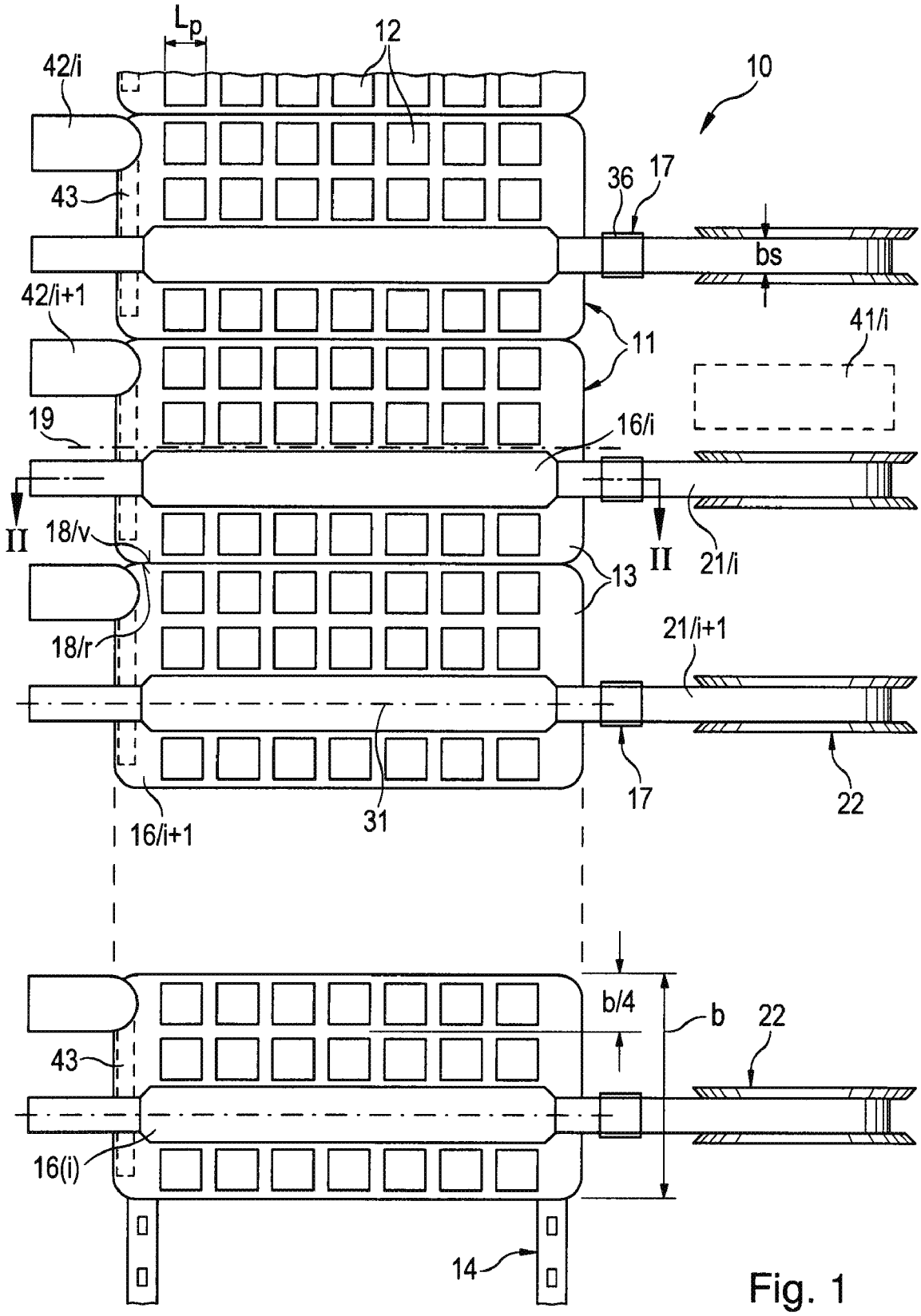

| | | | | | |
|---|---|---|---|---|---|
| DE | 10026331 | | 2/2002 | | |
| FR | 1001466 | | 2/1952 | | |
| GB | 2184086 A | * | 6/1987 | ..... | 53/561 |
| JP | 06092303 A | * | 4/1994 | ..... | 53/559 |

* cited by examiner

St
P

INSTALLATION FOR FILLING PACKAGING UNITS WITH MEDICAMENTS FOR PATIENTS ACCORDING TO THE PRESCRIBED WEEKLY REQUIREMENTS

The present invention relates to an arrangement for automatically filling packaging units of medication with administration forms—capsules, tablets, pills—of various medicaments corresponding to the individual weekly requirements of numerous patients, that are to be taken by the respective patient in an ordered sequence according to date—day of the week—and time of day—morning, midday, evening, night time—corresponding to a patient's medical prescription.

Packaging units of the type corresponding to the prior art have been used in the public domain in the Federal Republic of Germany in the form of medicament cassettes by the company Temmler GmbH and are therefore generally known.

Such packaging units are intended to help patients who regularly have to take a plurality of different medicaments, by ensuring on the one hand that the patients do not forget to take important medicaments, and on the other hand also providing a reliable check of which medicaments they have already taken, in order to prevent an over-medication, which could be dangerous.

The "usual" filling of such cassettes "by hand" is very time-consuming and in practice can be carried out sufficiently reliably only by highly qualified staff, which involves correspondingly high labour costs.

In order to reduce such costs, a compact arrangement suitable for use in the clinical sector is known [(IV/MEDI CO., LTD. 390-1, Shin Won Dong, Seo Cho Gu, Seoul, Korea)], in which medicaments corresponding to the weekly requirements of a patient can be mechanically filled in a packaging unit, and which obviously also assists in maintaining the correct chronological sequence for taking the medicaments. Computer-stored data relating to the patient and the relevant medical prescription are used for the individualised distribution of the medicaments from a magazine that contains up to 400 different medicaments in separate cassettes, as well as for the packaging, according to the order of administration, of the sorted medicaments in tubular packaging units, from which the medicaments can if necessary be removed for further sorting. The patient-related choice of the medicaments and their packaging is effected serially, in such a way that batches of medicaments associated with various patients can be obtained in sequence, i.e. where the choice of the medicaments for a patient is started only after the choice of the medicaments for a previously considered patient has been completed.

The known arrangement has the disadvantage that the filling of a plurality of packaging units takes a relatively long time, since the filling of a packaging unit can only be started after a necessary packaging to be filled beforehand has been completely filled. The known arrangement would not be suitable for a more or less industrial use in the wholesale pharmaceutical sector, in which it would be necessary to be able to turn out somewhere in the region of 50,000 packaging units per day. Such a quantitative requirement could not be practically met with the necessary degree of reliability.

The object of the invention is therefore to provide an arrangement of the type mentioned in the introduction, which enables a sharp increase in the number of deliverable, individually different consumption packaging units to be achieved, a typical order of magnitude for a 24-hour operation of the arrangement being 100,000 units, obviously with the secondary condition of as high a certainty as possible of conformity with the pharmaceutical regulations.

This object is achieved according to the basic concept of the invention as described herein.

According to this, in the filling arrangement according to the invention delivery stations individually associated with the medicaments are provided, in which a filling related to time of day or day of the week of receiving compartments of the packaging unit arranged one after the other in lines can be carried out; a "longitudinal" transporting device is furthermore provided, by means of which the packaging units can be transported in a predetermined transporting direction in sequence to delivery stations individually associated with the various medicaments, which stations are in this connection provided in a multiplicity corresponding to the number of medicaments and can be used to fill different cassettes; the supply of the medicament administration units to the delivery stations is effected by means of transverse conveying devices individually associated with the medicaments, which can be controlled in parallel to the delivery of medicaments that are delivered for filling a plurality of different packaging units; for this purpose the longitudinal transporting device and the transverse conveying devices are comprehensively matched to one another as regards transporting stroke and conveying capacity, so that in each case a line-by-line filling of the receiving compartments per transporting stroke of the packaging units and per conveying stroke of the transverse conveying devices can be achieved, which in each case conveniently takes place in synchronised stoppage phases of the longitudinal transporting and medicament conveying cycles; in the case of specific simple, regular filling patterns a continuous feed is possible for the "longitudinal" transportation of the packaging units as well as, alternatively or in addition, for the transverse conveyance of the medicament; by means of an electronic control unit provided for controlling the delivery stations, which unit generates the necessary control signals by processing information signals that contain information on the patients and the content of the packaging units associated in each case with the patients and which are continuously fed to the control unit in a sequence highly correlated to the cassette feed movements and unambiguously associated with the patients, the greatest possible reliability of the correct filling of the packaging units with medicaments can be obtained and also a high feeding rate per unit time can be achieved, so that fully filled packaging units that in each case correspond to an individual medical prescription can be removed from the arrangement at a rate of about one per second.

If data in machine-readable form that can be processed into the control signals are provided in a spatially fixed allocation to the respective packaging units, i.e. can be further transported with the latter and thereby reach reading stations that are associated with the delivery stations, then the filling sequence can be controlled in a simple way in the manner of a sequential control that can manage effectively with a relatively small data processing capacity and accordingly operates quickly and reliably.

In this connection an arrangement of a reading station associated with an delivery station is convenient that permits the data to be read in already before the cassette to be filled has arrived at the relevant delivery station.

The packaging units and the parts of the latter bordering the receiving compartments are conveniently also provided with printable areas, on which label-type information can be printed out by means of printing devices in each case individually associated with the delivery stations and integrated therein, on the basis of which the filling of the respective packaging unit can in each case be replicated, which can be of great importance for reasons of error protection and any necessary defect analysis.

In a preferred configuration of the filling arrangement according to the invention the medicaments—tablets, capsules, pills or the like—are arranged equidistantly on blister strips that are wound on a feed roll and transporting drives are arranged between the roll stations and the delivery stations, which, seen in the transporting direction of the blister, have ejection units arranged one after the other, by means of which the medicaments can be ejected from the blister wells and delivered into the receiving compartments of the respective packaging units.

This type of medicament stocking and provision of the arrangement and realisation of the medicament delivery to the packaging units is suitable in particular for a modular construction of the overall arrangement, in that an expansion of the arrangement to accommodate a large variety of medicaments is possible without any problem and can be achieved by inserting a unit associated with the new type of medicament. Also, a "modular" subdivision of the arrangement into groups of delivery stations and storage rolls associated with the latter, for example in groups of ten delivery stations or a "master" grouping, in which for example five such groups of ten are combined to form a master modular unit, is possible without any problem, and appears advantageous for control purposes, for example from the aspect of achieving as uniform as possible filling times for all medicament cassettes.

From the control technology aspect it is particularly advantageous if also the ejection units of a delivery station are equidistantly arranged with respect to one another, preferably so that the interspacing Lp of adjacent ejection units is a whole-number multiple of the interspacing Ip of adjacent blister wells of the blister strips. With this configuration of the delivery stations a simple stepping-type transportation, achievable for example by means of a Maltese cross, can be provided for transporting the blister strip, which in functional combination with a step counter enables a reliable feed movement control to be achieved in a simple way. It is understood that, in combination with a suitably chosen path measurement system, a continuous blister strip feed can also be provided.

Pneumatic Lear cylinders, which may be designed as simple-acting cylinders equipped with restoring springs, or depending on the force requirements in the alternative movement directions may also be designed as double-acting cylinders, are particularly suitable as ejection units. Features of the blister strips described below can be realised alternatively or in combination, which permit a reliable transportation and also permit in a simple way an automatic "feeding in" one after the other of blister strips to be used.

Configurations of the storage blister strips are obtained that ensure a smooth delivery of the medicaments from the blister wells by ejection by means of the ejection elements, since the "ejection" forces that have to be exerted on the medicaments by means of the ejection elements of the respective delivery station can be kept low. Other advantages of the invention include a particularly smooth handling, which is protected against wear and also against contamination, of the medicaments to be delivered.

By means of a device described below for a common opening actuation of release elements, a structural simplification of delivery stations as well as a time-saving implementation of the delivery of medicaments to the receiving compartments can be achieved.

In combination with drives, simple incremental path transmitters can be used to measure the path or determine the forward feed of the blister strips, the signals from which transmitters in combination with position transmitters for edge markings of the blister strips can be used to provide sufficiently accurate position determinations for controlling the movement of the blister strips, for which purpose suitable edge markings can be obtained by means of marking devices of the arrangement itself. To this end cutting stations may also be used. Safety sensor devices provided for checking the functioning may be realised in an advantageously simple arrangement and configuration.

Thanks to a modular structure of the filling arrangement according to the invention, in which its modules in each case comprise a delivery station, a transverse conveying device, a storage roll per blister strip, as well as feed drives and auxiliary drives together with the necessary path measurement sensors and monitoring sensors, it is possible without any problem by adding such modules for statistically commonly required medicaments, to realize with comparatively little expenditure and effort "uniformly" and demand-oriented operating filling arrangements.

Alternatively or in addition, a demand-oriented expansion of the capacity of a filling arrangement according to embodiments of the invention can also be achieved with two or more transporting systems for packaging units.

By means of a configuration of the filling arrangement a continuous filling operation can then also be realised with a uniformly constant medicament flow, when the time required at the individual delivery stations is different.

A particularly efficient production of blisters for weekly requirements as packaging units can be achieved in the preferred configuration of the filling arrangement, as described below.

Figures 2A, 2B, 2C, 2D, 2E:
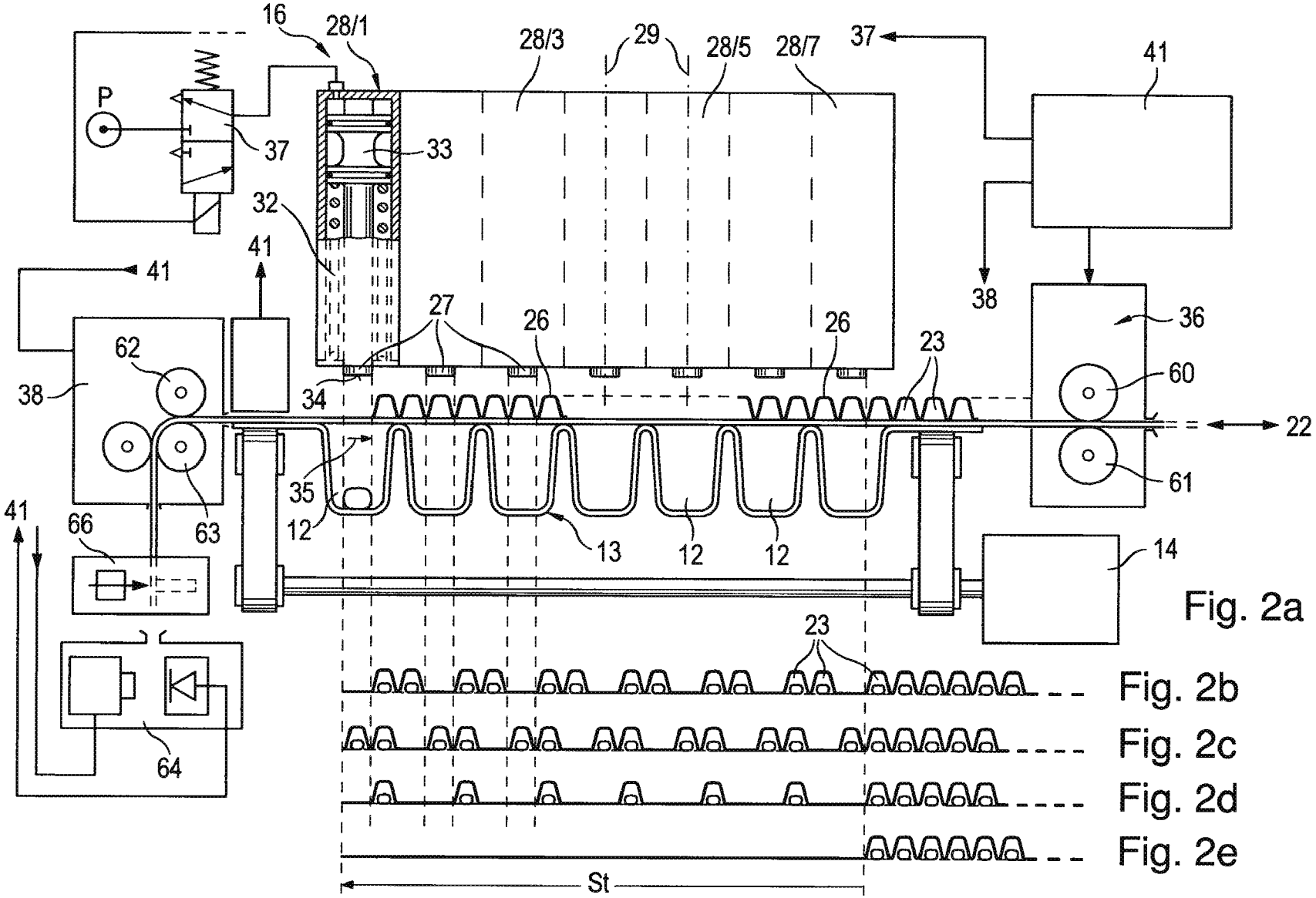
Figure 3A:
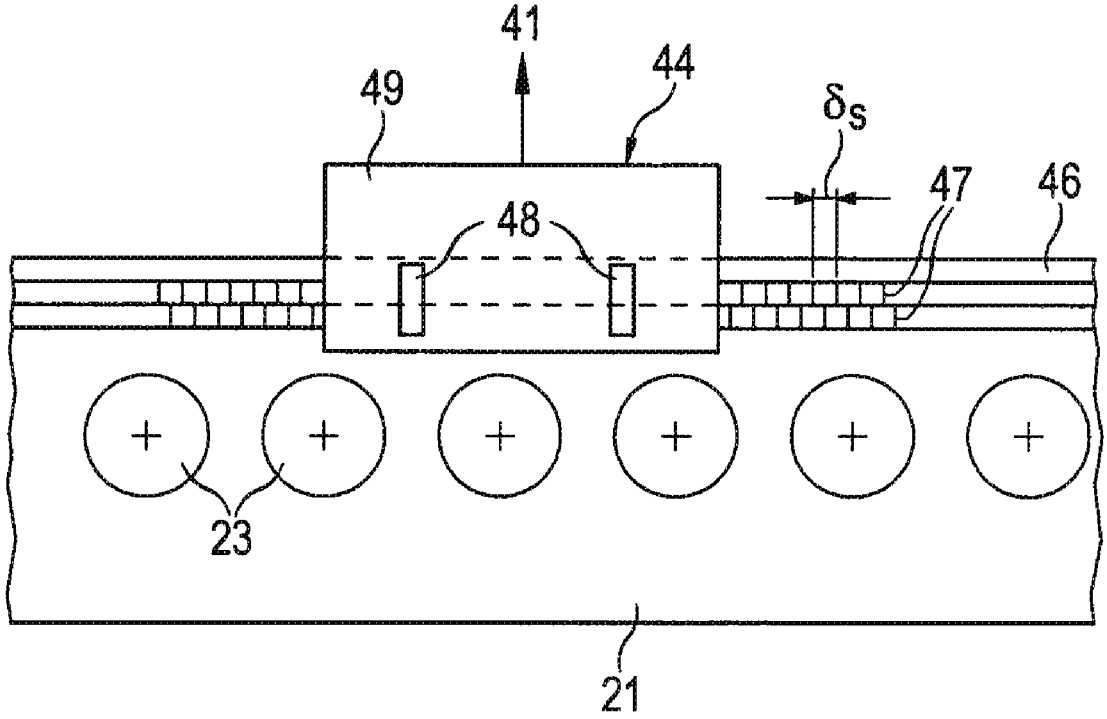
Figure 3B:
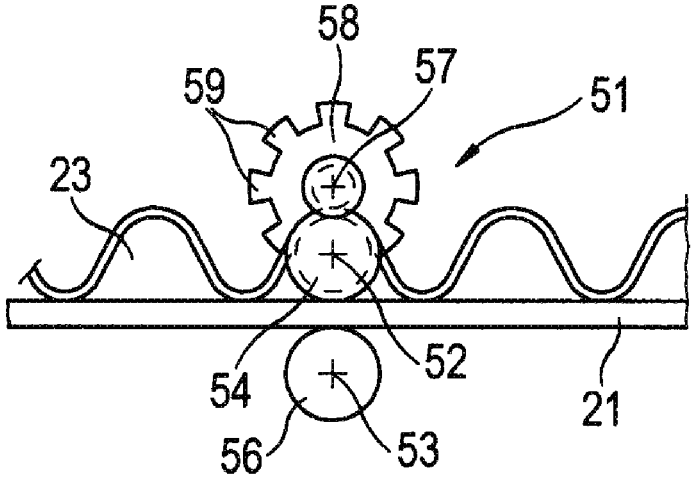
Figures 4A, 4B:
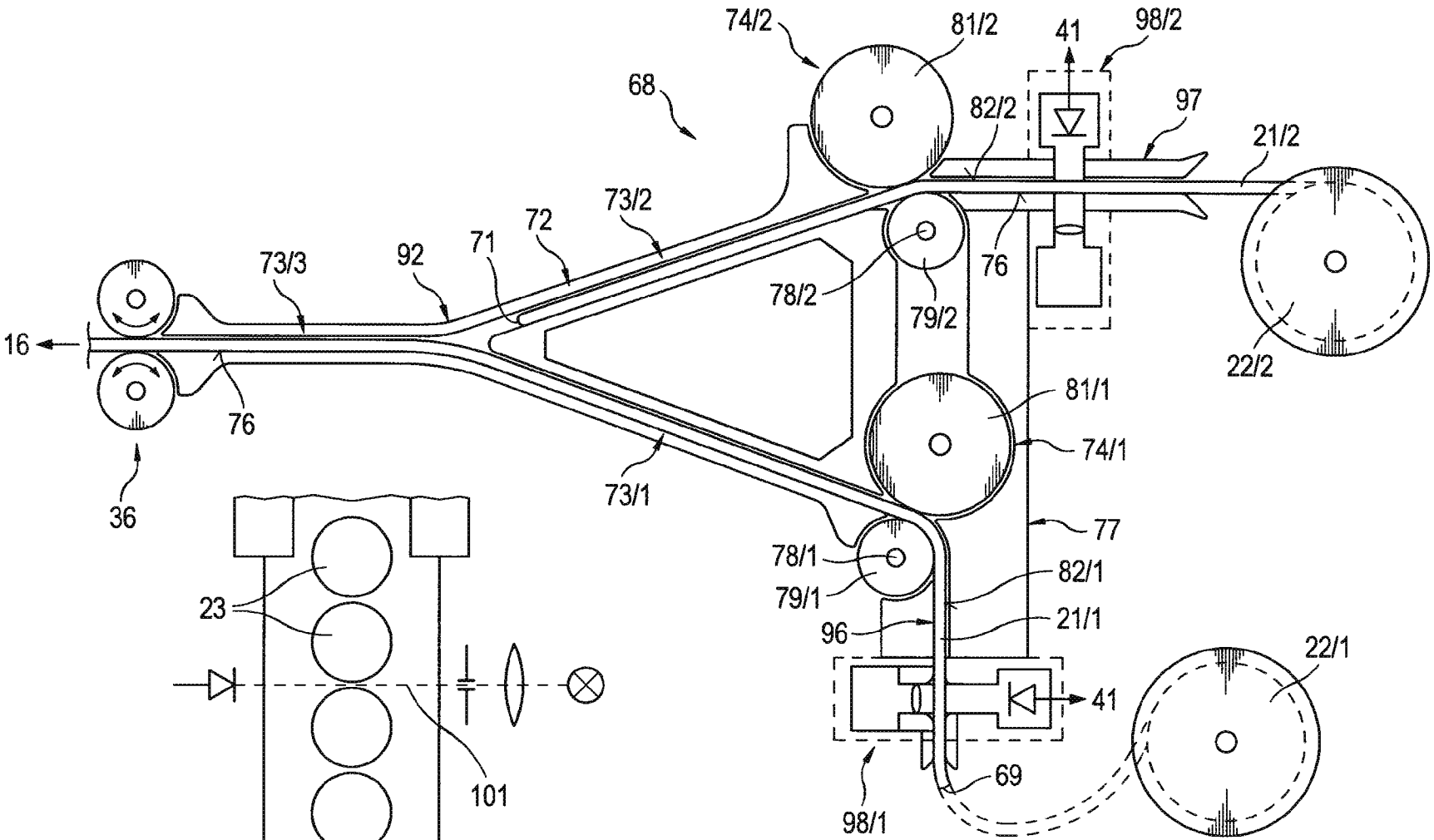
Figure 5A:
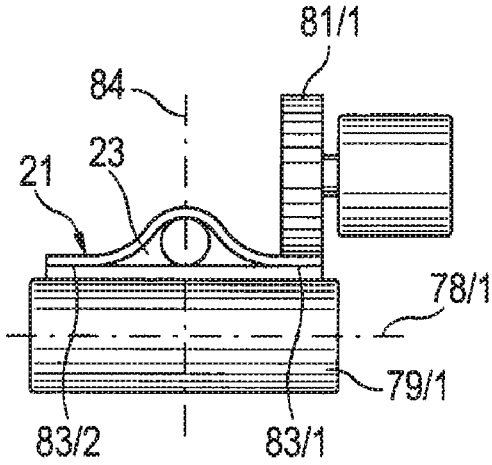
Figure 5B:
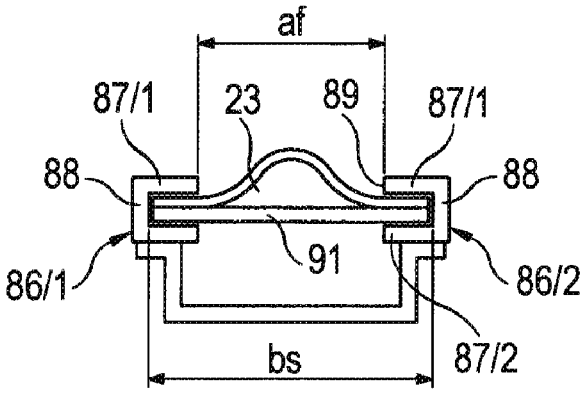
Figure 5C:
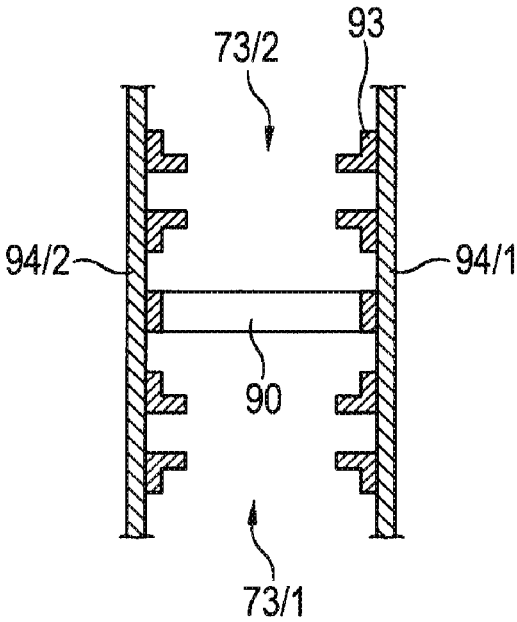
Figure 6A:
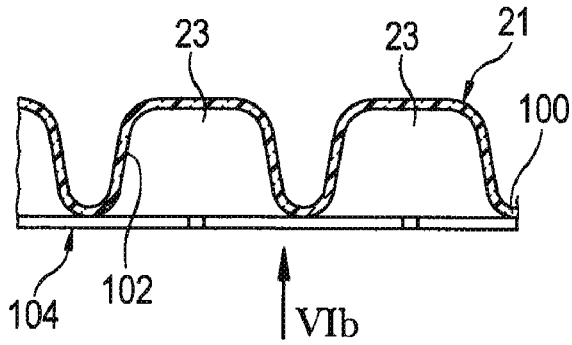
Figure 6B:
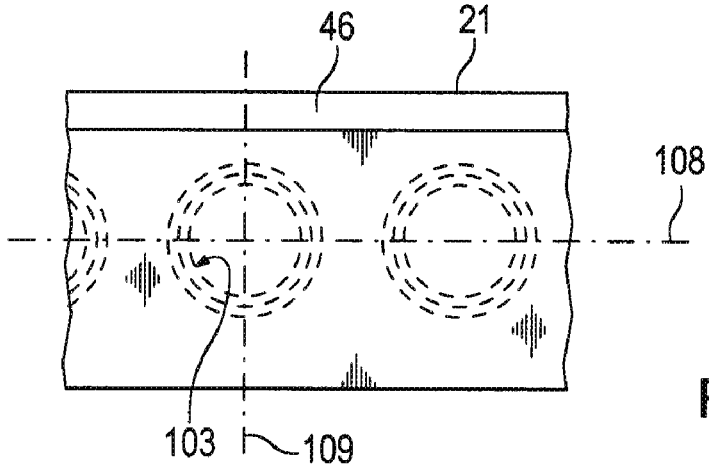
Figure 6C:
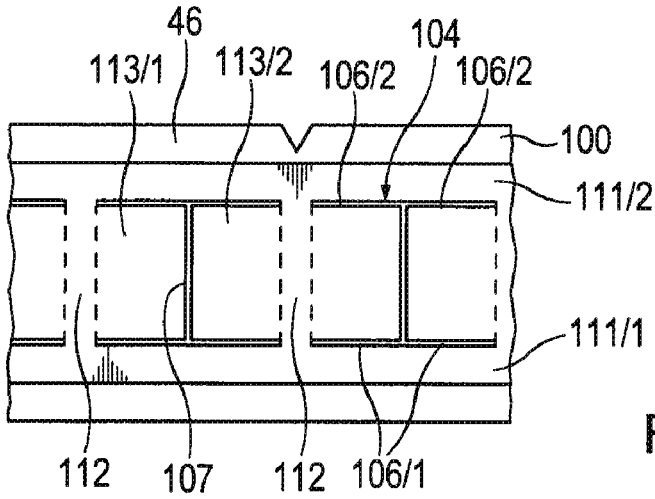
Figure 6D:
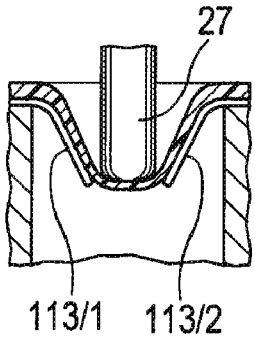
Figure 7A:
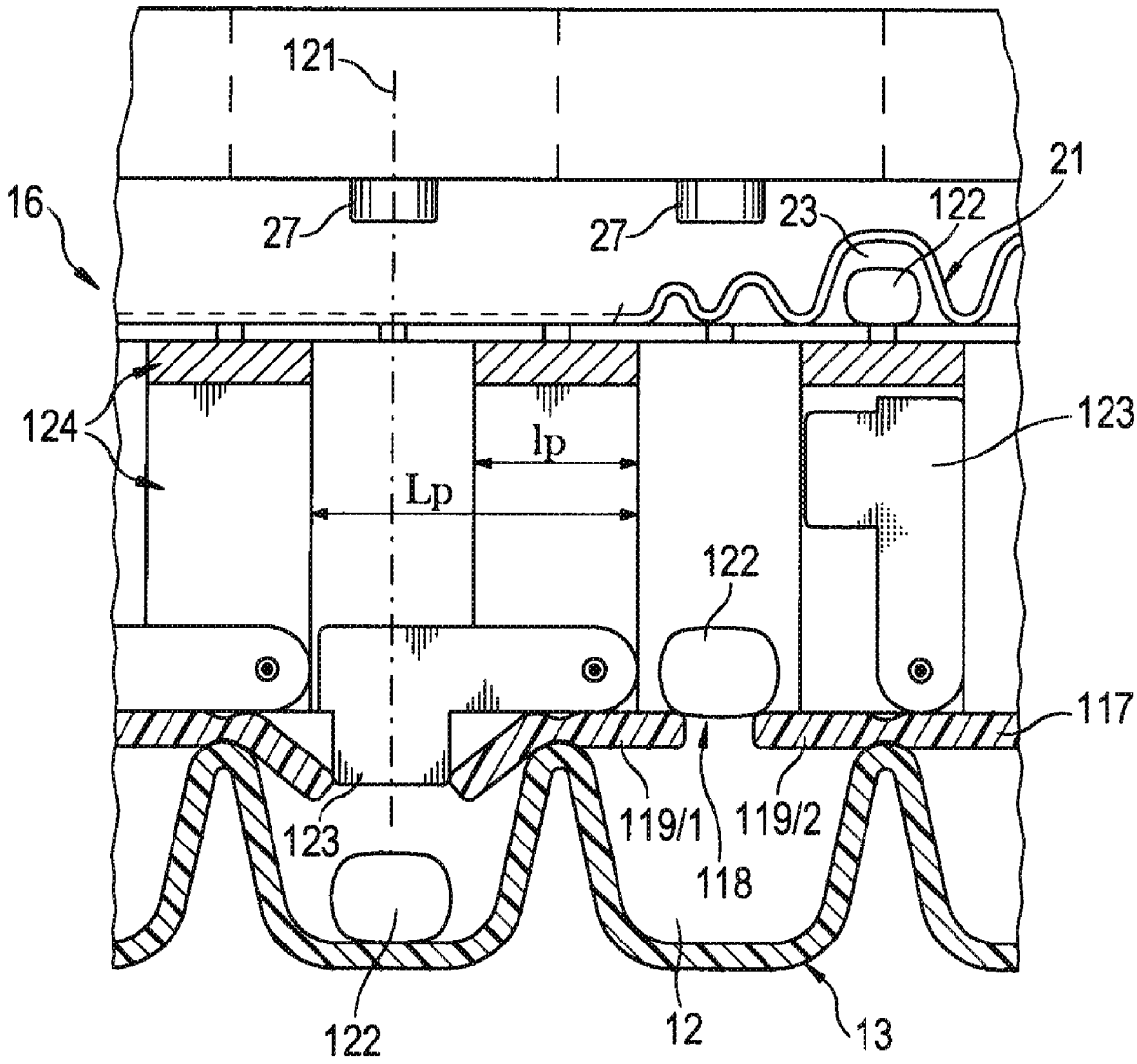
Figure 7B:
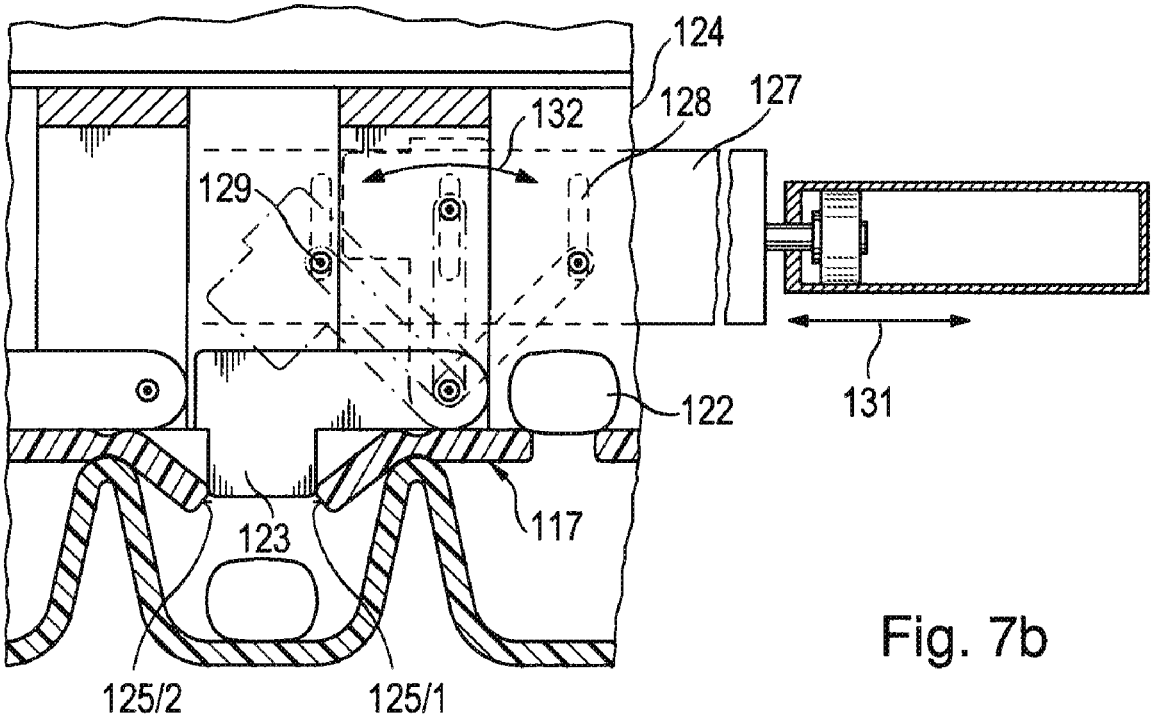
Figure 7C:
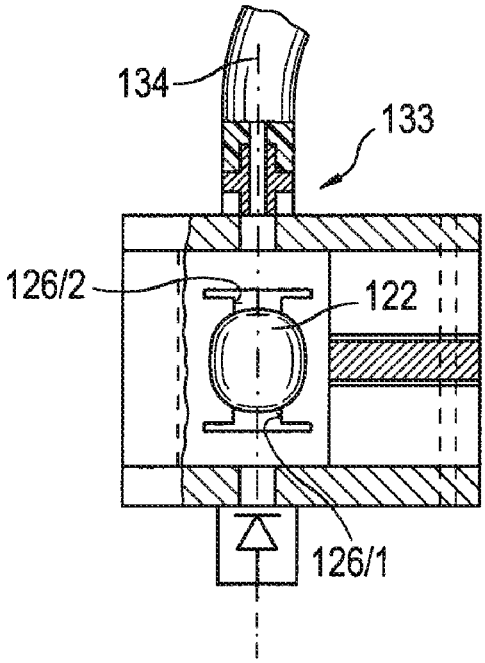

Further details of the invention follow from the following description of embodiments with the aid of the drawings, in which:

FIG. 1 is a diagrammatically simplified plan view of a first embodiment of an arrangement according to the invention for filling packaging units of medicaments, FIG. 2*a* shows details, likewise diagrammatically simplified, of a delivery station of the arrangement according to FIG. 1 in a section along the line II/II of FIG. 1, FIGS. 2*b* to 2*e* show various phases of the delivery of medicaments to the delivery station according to FIG. 1, in order to illustrate the functioning of the arrangement, FIG. 3*a* shows details of a further embodiment of an arrangement according to the invention in a form corresponding to FIG. 1, FIG. 3*b* is a diagrammatically simplified view of an incrementally operating path transmitter that can be used in the arrangement according to FIGS. 1 or 3*a*, FIG. 4*a* is a diagrammatically simplified side view of a switching device suitable for changing blister strip storage rolls, FIG. 4*b* is a suitable light barrier arrangement for generating marking signals in an arrangement according to FIGS. 1 or 3*a*, FIG. 5*a* shows a drive device for the transporting drive of a blister strip according to FIG. 4*a*, FIGS. 5*b* and 5*c* each show a guide device of the switching device according to FIG. 4*a*, FIGS. 6*a* to 6*d* show details of the blister strip configuration in order to illustrate its functioning, FIG. 7*a* shows a further configuration of a delivery station of an arrangement according to FIG. 1 in a view corresponding to FIG. 2*a*, FIG. 7*b* shows details of a drive of the delivery station according to FIG. 7*a* and FIG. 7*c* is a simplified sectional view of a monitoring light barrier for the delivery station according to FIG. 7*a*.

The filling arrangement, identified overall by the reference numeral 10 in FIG. 1, is intended for filling packaging units 11 with medicaments that are to be taken by a patient during the course of a week, these packaging units being intended to help the patient in that the latter, in accordance with a medical prescription, takes a plurality of different medicaments in a proper regulated dosage and time sequence, and thereby does not forget a medicament and can also check in a simple way what medicaments have already been taken and/or what still remain to be taken.

The packaging units 11 are designed in the manner of blister packs comprising a plurality of receiving compartments 12 having a basic rectangular trough shape, which are combined in a regular rectangular matrix configuration to form a uniform transporting sheet 13. Corresponding to a layout as a so-called "week blister", with which the weekly medicament requirements of a patient are provided, the transporting sheet 13 comprises a total of twenty eight receiving compartments 12 of identical basic shape, which in the special embodiment chosen for the explanation are arranged in a number of columns corresponding to the number of days of the week, and in four lines associated with the various times at which the medication is taken, namely morning, midday, evening and night time.

Seen in the direction of the four lines and in the direction of the seven columns of the respective transporting sheet 13, the receiving compartments 12 are in each case arranged equidistantly.

By means of a longitudinal transporting device, illustrated simply diagrammatically and identified overall by reference numeral 14, which may be realised in the nature of a "linear" conveyor belt device that has its own drive, or may be realised by means of a plurality of drives that engage "directly" on the transporting sheets 13, the transporting sheets 13 to be filled with the medicaments can be transported sequentially to delivery stations identified overall in each case by the reference numeral 16, arranged sequentially along this transporting direction 14. A medicament is in each case delivered at these delivery stations, the delivery of the medicaments at the respective delivery station 16 taking place "line-by-line", in such a way that during a stopping phase of the longitudinal transporting device 14 the administration units associated in each case with the administration time, namely morning, midday, evening or night time, are fed into the receiving compartments 12 associated with the respective administration days, namely Monday and/or Tuesday, etc., up to Sunday.

The feed of the medicaments to the delivery stations 16 is carried out by means of transverse conveying devices individually associated with the medicaments and in each case identified overall by the reference numeral 17, which are arranged equidistantly along the transporting device 14 in the transporting direction of the transporting sheets 13, the interspacing between adjacent transverse conveying devices 17 conveniently being chosen to be equal to the width b of the transporting sheets 13 measured in the transporting direction, and the sheets 13 for their part are configured so that in a transporting configuration of the sheets 13 in which these rest directly against one another with their edges 18/*r* and 18/*v* running transverse to the transporting direction, the interspacing of the in each case adjacent rows of receiving compartments, one of which is associated with the night time medicament taking and the other of which is associated with the morning medicament taking, is the same as the interspacing of two rows of compartments adjacent to one another within a sheet 13 and corresponds to the forward feed step size with which a for example pulse-controlled forward feed of the transporting plates 13 takes place in the transporting direction of the transporting device 14. In a typical configuration of the transporting sheets 13 these are designed symmetrically in terms of their respective longitudinal mid-plane 19 that runs between the two inner rows of receiving compartments 12 associated with the midday and evening taking of medicaments, and is perpendicular to the plane marked by the opening edges of the receiving compartments 12.

The transverse conveying devices individually associated with the medicaments are realised with the aid of blister strips 21, which are wound on storage rolls 22 and can be withdrawn from these. The storage rolls 22 are accommodated by flat cassettes (not shown for the sake of simplicity), which may also form the bearings in which the rolls, if the exchangeable cassettes are used in the arrangement 10, are rotatably mounted.

The blister strips 21, for a description of which reference will now also be made to FIGS. 2*a* to 2*e*, consist of strip-shaped plastics films 26 with semicircular or trough-shaped wells 23 formed on one side, which are provided to take one tablet or one medicament capsule each. The wells containing the respective medicaments are covered with a film-shaped cover strip 24 that is connected in a materially interlocking manner to the plastics strip 26 forming the wells 23. The cover strip 24 may for its part be formed as a plastics strip, but is however often also formed as a thin aluminium strip or as a metallised plastics strip that is provided in the region of the well openings with embossings or functionally similar perforations acting as intentional score lines, which facilitate the opening or the mechanical removal of the medicaments from the wells 23.

The wells 23 are, in the configuration example given for purposes of description, arranged directly—"tightly"—next to one another on the blister strips 21 so as to achieve as high a storage capacity as possible per storage roll 22. Seen in the transporting direction of the blister strips 21, which cross over the seven receiving compartments of the receiving compartments 12 arranged in each case next to one another in a daytime line, these too are as it were arranged equally tightly, i.e. immediately adjacent to one another, so that separating webs remaining between two adjacent receiving compartments 12 and running in the transporting direction of the week blisters are tightly up against the clear width of the receiving compartment openings measured transversely to the transporting direction of the week blisters. In a typical configuration of the week blister transporting sheets 13, the periodicity length Lp of the line arrangement of the receiving compartments 12 of the transporting sheet 13 measured transversely to the transporting direction of the week blisters 11, corresponds to three times the value Ip of the correspondingly measured periodicity length of the arrangement of the wells 23 of the blister strips 21 or to another whole-number multiple of this periodicity length Ip, preferably to an odd multiple of the latter.

In this matching of the periodicity lengths Ip and Lp of the blister strips 21 and the line arrangements of the receiving compartments 12 of the transporting sheets 13, it is always possible to place a well 23 of the blister strip running along the receiving compartment line, "centrally" over each of the receiving compartments 12, and in this central arrangement to deliver the medicament contained in the well 26 into the receiving compartment 12 of the transporting sheet 13 of the week blister 11 arranged immediately thereunder.

In order to control the delivery of medicaments from the blister strips 21 into the receiving compartments 12 of the transporting sheet 13, seven ejection tappets 27 that can move in a reciprocatory manner perpendicular to the opening plane of the receiving compartments 12 of the transporting sheets 13 are provided per delivery station 16, a pneumatic actuating cylinder 28/1 to 28/7 each being provided to actuate their ejection.

The actuating cylinders 28 of the respective delivery station 16 are arranged in the case of an identical configuration so that their central longitudinal axes 29, which are also the central longitudinal axes of the ejection tappets 27, span a longitudinal mid-plane 31 (FIG. 1) of the respective delivery station running perpendicular to the opening plane of the transporting sheets 13 and at right angles transversely to the transporting direction of the transporting sheets 13.

For the purposes of the description it is assumed to start with that the actuating cylinders 28/1 to 28/7 can be actuated individually at different times as well as simultaneously in a multiplicity of arbitrary combinations. It is also assumed that the actuating cylinders have a restoring spring 32 that forces the piston 33 of the respective actuating cylinder 28 and thus also the respective tappet 27 into its upper end position as base position, in which the respective actuating tappet 27 is retracted from the in each case associated receiving compartment 12 of a transporting sheet 13 to be filled, and its free end face surface 34, which conveniently has a shape that is adapted to the shape of the medicament to be ejected, for example a concavely curved shape approximately complementary to this shape, is arranged at a vertical distance from the outsides of the blister well 23, so that a blister strip 21 can be moved unhindered between a transporting sheet to be filled and the actuating cylinders 28 of the delivery station 16 arranged thereabove, into its delivery positions, which may if necessary require a multiple reciprocatory movement of the blister strip 21 at the delivery station 16.

The need for this exists for example if a medicament is not to be taken on each day of the week, but for example only on Monday, Wednesday and Friday, the aim being to avoid medicaments being transported beyond the delivery station due to a continuous further transportation of the respective blister strip, which would thereby involve either considerable effort in recovering these medicaments or these medicaments would have to be regarded as lost. In order in this example to realise the appropriate control of the delivery with as small an expenditure of transporting resources and time as possible, the following procedure is conveniently adopted:

For the purposes of description the starting point will be the configuration, shown in FIG. 2*a*, of a delivery station 16, in which all wells of the blister strip 21, which according to the illustration are arranged to the right of the well 23, which is situated underneath the tappet 27 of the actuating cylinder 28/1 one arranged furthermost on the left, for example that associated with Monday, including this well itself, still contain the medicament administration unit to be provided at this delivery station 17. Seen in the conveying direction of the blister strip 21, all medicament administration units originally arranged on the left-hand side underneath the tappet 27 of the "Monday" actuating cylinder 28/1 have however already been delivered.

In this "starting" configuration the "Monday" cylinder 28/1 is actuated first, whereby the medicament contained in the well arranged furthermost on the left hand side according to the illustration of FIG. 2*a* is delivered into the "Monday" receiving compartment 12 arranged thereunder of the transporting sheet 13. After the tappet 27 of the ejection cylinder 28/1 has again disengaged from the transporting blister 21, it is retracted "to the right" in the direction of the arrow 36 until the well 23 now arranged in the furthermost left-hand position and still containing a medicament is arranged underneath the tappet 27 of the ejection cylinder 28/3 associated with Wednesday, which is then actuated. For the next ejection cycle the blister 21 is retracted until the well, now arranged furthermost on the left hand side and still filled, is arranged underneath the tappet of the ejection cylinder 28/5 associated with Friday, whereupon this is actuated. After the penultimate delivery actuation the blister strip 21 can remain in the position it has now adopted and can be transported in a subsequent delivery cycle to the starting position that is most suitable for this.

For the—statistically more significant—case that at a delivery station 17 in each case all seven receiving compartments 12 are to be filled with the delivery medicament of this station 16, a simple possible way of controlling the delivery is as follows:

For purposes of description the starting point is again the configuration of delivery station 16 and blister strip 21 illustrated in FIG. 2*a*. In the "starting" configuration given thereby, all seven actuating cylinders 28/1 to 28/7 are simultaneously controlled to execute the ejection stroke of their ejection tappets 27 and after this are immediately controlled again to execute the return stroke to the illustrated base position. The configuration of the blister strip 21 after the execution of the ejection stroke is illustrated in FIG. 2*b*. The administration unit—tablet or pill—ejected in each case is now in one of the (in the illustrated embodiment four) receiving compartment lines of the transporting sheet 13 relating to the time of day. After the further transportation of the transporting sheet 13 by for example a "day" step size of the amount b/4 (FIG. 1) and further transportation of the blister strip 21 with respect to the delivery station by a periodicity length of the well arrangement, the configuration of the blister strip 21 with regard to the delivery station 16 is that shown in FIG. 2*c*, in which now again by joint control of the actuating cylinder 28/1 the next receiving compartment line of the transporting sheet 13 relating to time of day can be filled with an administration unit of the medicament made available at the delivery station. The resultant configuration of the blister strip 21 is shown in a diagrammatically simplified manner in FIG. 2*d*.

Renewed repetition of the aforementioned transporting and incremental steps finally leads to the configuration of the blister strip 21 shown in FIG. 2*e*, which now requires a transporting displacement of the blister strip by the transporting stretch identified as St in FIG. 2*e*, so that the blister strip position adopted as starting position is reached again, in which the aforedescribed delivery cycles can be restarted.

Control signals for electromechanical feed drives 36 illustrated simply diagrammatically in FIG. 1 and FIG. 2*a*, by means of which the blister strips 21—transversely to the transporting direction of the transporting sheets 13—can be transported to the individual delivery stations 16 formed by the pneumatic ejection cylinders 28/1 to 28/7 and can as it were be fed to the cylinders, and in addition if necessary limited backward movements can also be controlled and furthermore control signals for magnetic valves 37, by means of which the ejection cylinders 28/1 to 28/7 can be charged individually or as a plurality, optionally all simultaneously, with pressure from a compressed air source (not shown) and/or after execution of their working stroke the pressure can again be released, as well as further control signals for electromechanical auxiliary drives 38 that can be used to transport away emptied blister sections and/or to clamp the blister strips underneath the ejection cylinders 28/1 to 28/7, are generated by means of electronic control units 41 individually associated with the delivery stations 16, which units can be controlled in the pulse cycle of the forward feed transporting movements of the transporting sheets 13 in the signal generation operation in such a way that the operating phases of the electronic control units 41 are as it were synchronised by the transporting cycle of the transporting device 14. The transporting device 14 is conveniently designed as an incremental device, with short transporting phases, and compared to these temporarily very much longer stoppage phases, in which per transporting cycle in each case the next "line"—group of seven receiving compartments 12—reaches the delivery position underneath the delivery cylinders 28/1 to 28/7 of the respective delivery station 16.

The electronics control units 41 of the delivery station 16 generate the control signals for the blister feed drives 36, for the control valves 37 of the ejection cylinders 28/1 to 28/7, as well as for the respective auxiliary drives 38 of the delivery station 16 by processing patient-related data that are stored in a machine-readable form on a data carrier, which is "fixedly" associated with each transporting sheet and can as it were be entrained by the latter. The data carrier contains in suitably coded form, e.g. as a binary number, the name of the medicament that is to be delivered to the addressed delivery station 16. The corresponding delivery station 16 is as it were addressed through this information, i.e. is prepared for a delivery cycle. Accordingly a reading head 42(*i*), simply diagrammatically illustrated in FIG. 1, is arranged with respect to the delivery station 16*i* associated with it [(i=1 . . . n; n=number of the delivery stations of the arrangement 10)], so that between the reading of the information and the addressing of the delivery station 16(*i*) to be controlled, sufficient time is available for a reliable processing of the information data.

In the special embodiment chosen for the description, the data carrier 43 is arranged on one transverse edge, according to FIG. 1 the left-hand edge, running in the transporting direction, of the respective transporting sheet 13. Apart from the identification of the respective medicament, data individualising the patient, as well as data containing the—chronological—administration pattern, are also stored in a machine-readable form on the data carrier 43.

In the aforedescribed arrangement of reading head 42*i* and delivery station 16*i*, the time window within which the ejection cylinders 28/1 to 28/7 of the respective delivery station 16 are actuated is determined by the number of the incremental steps of the transporting device 14 by which the reading head 42 is traversed earlier by the respective receiving compartment line than their receiving compartments are filled with the respective medicament at the delivery station.

The control of the feed movements of the blister strips 21 is explained for the embodiment chosen for the description on the basis of the function of the control and drive elements involved therewith, whose technical implementation can then be effected in various ways without any problem by the person skilled in the art; accordingly the apparatus details will be discussed only insofar as they are specific to the filling arrangement 10 according to the invention.

The "addressing"—preparation of the filling operating phase at a selected delivery station 16*i*—is carried out in that the information signals to be processed by the electronic control unit 41*i* are already read into the control unit 41*i* by means of a reading head 42*i* associated with the said unit, while the transporting sheet 13 to be filled at the delivery station 16*i* is still in the region of that delivery station 16(*i*-1) that, seen in the transporting direction, is arranged upstream of the delivery station 16*i*.

Already in this situation, if the delivery station 16*i* is not for its part still working in the loading operation, the loading operation for the transporting sheet 13 still situated at the station 16(*i*-1) can be prepared in that the blister strip 21*i* that can be taken from the storage roll 22*i* is transported into the starting position suitable for the filling procedure, for example the position illustrated in FIG. 2*a*, which for the function example illustrated on the basis of FIGS. 2*a* to 2*e* would require the blister strip 21*i* to be retracted by the stretch St (FIG. 2*e*).

On the basis of the data read into the control unit 41*i*, this generates the batch of control signals that trigger the forward feed and return movements of the blister strips, which have to be executed at the "line" tracks associated with the various times of taking the medicament—morning, midday, evening, night—as well as the data for the selection of the ejection cylinders to be activated. The output of the control signals representing these data then takes place in a pulse-controlled manner by electrical signals that are continuously generated with execution of the incremental movements of the transporting sheets 13.

In this connection the various feed movements to be executed within a delivery cycle of the delivery station 16*i*, likewise in alternating directions, is predetermined according to the amount and direction.

In order to determine the transporting path executed in a predetermined direction, an "incremental" path measurement system diagrammatically illustrated in FIG. 3*a* and identified overall by the reference numeral 44 is provided, which issues a counting pulse to the electronics control unit 41*i* for each "small" path increment travelled in a predetermined direction, which pulses are summated with a positive or negative sign depending on the direction of movement—forwards/backwards—so that the sum reached within a delivery cycle is a measure of the length of the thereby withdrawn blister strip.

FIG. 3*a* shows a simple way of realising an incremental measurement path system, in which successive "dash" markings 47 are provided one after the other at a small interspacing δs along an edge strip 46 of the blister strip 21 that is to be monitored as regards its movements, which move past one or more sensors 48, shown simply diagrammatically, of a stationary measurement head 49, in order thereby to trigger the generation of a counting pulse. Perforations that can easily be recognised optically are suitable as edge markings 47, though magnetic markings known from magnetic tape technology that can be detected with standard reading heads and are suitable for emitting incremental counting pulses, can also be used.

An incremental path measurement system 51 suitable for a filling arrangement according to the invention can, as can be seen from FIG. 3*b* alternatively be designed as an "independent" functional unit that manages without marking measures on the respective blister strip 21.

The path measurement system 51 according to FIG. 3*b* has two castors 54 and 56 freely rotatable about parallel axes 52 and 53, which are arranged facing one another and are pressed with a minimum force against the oppositely facing edge strip boundary surfaces of the blister strip 21 and are frictionally coupled to the latter in movement. One of the sliding rollers 52, namely the upper one illustrated in the embodiment, engages in an interlocking manner via a flat circumferential toothed region with a gear 57 of smaller diameter, which for its part is rotationally fixedly connected to a bladed wheel 58 whose blades 59 can be used to generate counting pulses to interrupt light barriers or for a position-dependent tuning of inductive sensor circuits, wherein by using suitable transmission ratios an as it were high-resolution splitting of the blister strip displacement path into a plurality of path increments can be achieved, which are small in size compared to the dimension of the blister well 23 in the transporting direction.

By means of the circumferential toothed region with which the sliding roller 54 is supported on the edge strip of the blister strip 21, thanks to a constantly existing flexibility of the blister strip material an interlocking engagement of the roller 54 with the blister strip 21 is achieved, which permits a precise path measurement.

Also, the drive and guide rollers 60 and 61 of the feed drive 36 used to achieve an at times pulling and at times pushing drive of the blister strip, as well as the drive and guide rollers 62 and 63 (FIG. 2*a*) of auxiliary drives 38, are conveniently provided with "flat", i.e. radially only slightly extended and also substantially edge-free toothed regions, which on account of an elastic deformability of the carrier material of the blister strips 21 can engage therewith in a quasi-interlocking manner, which promotes the reliability of the transportation.

If an incremental measurement system is used to control and monitor the position, it is necessary to be able to generate from time to time a characteristic indicating signal for a defined, selected reference position that for the selected arrangement and configuration of the employed incremental path measurement system is coupled to a defined counter state, in order to be able to check on the basis of the occurrence of this signal whether the measurement system has also reached that counter state that has to be given at the position of the blister strip recognised by the signal. In the case of a deviation the occurrence of the position-characteristic signal can be used to carry out a "post" calibration of the measurement system, in that the counter of the measurement system is set to the position-characteristic value. Conveniently a post-calibration or check of this type is always independently carried out when the blister strip has reached the referenced position.

With the embodiment used in the above description a light barrier identified overall by the reference numeral 64 (FIG. 2*a*) is used to generate the reference mark indicating signal, the reference signal being generated when the light barrier is interrupted by the blister carrier. This signal occurs as soon as a free transverse edge of the "consumed" blister strip end section, from which previously a consumed end piece of the blister strip 21 has been cut off by means of a cutting device identified overall by the reference numeral 66, interrupts the sensor light beam of the light barrier 64.

It is understood that suitable reference marks may also be applied in another way, for example by stamping out a perforation hole "somewhere" on the edge of the blister carrier, through which the sensor light beam of a light barrier can pass for the purposes of triggering a position indicating signal. Imprints which can be optically detected, or inductively-detectable metal marks, may also be used as reference marks as appropriate.

It is expedient if, seen in the transporting direction, the position of the blister strip 21 can be determined before it enters the delivery station 16 as well as after it has left the latter, i.e. if it can be used to emit a "calibration" control signal.

The ability to determine the forward feed and possible backward movements of the blister strips 21 and to be able to control the magnitude of the movements as well as their speed is utilised in a configuration represented by the detailed diagram of FIG. 4*a*, of a filling device according to the invention for an independent transfer from one storage roll 22/1 to a second storage roll 22/2, so that at a delivery station 61 with which both storage rolls 22/1 and 22/2 are associated, after the blister store on the first used storage roll 22/1 has been exhausted, a changeover to the blister strip store wound on the second storage roll 22/2 can be effected without having to interrupt the filling operation of the filling arrangement 10.

A changeover device provided for this purpose and identified overall by the reference numeral 68 here performs the function that, as soon as the blister strip store that can be withdrawn from the store roller 22/1 is exhausted, a changeover to the removal of the blister strip 21 from the second storage roll 22/2 is effected, and a common transportation of both blister strips 21/1 and 21/2 is achieved in such a way that a free "backward" end 69 of the "consumed" blister strip 21/1 and the free "starting" front side 71 of the next blister strip 21/2 to be used are brought together and, while the end section of the exhausted blister strip 21/1 and the starting section of the following blister strip 21/2 are transported through the delivery station 16, are held adjacent to one another until the transfer to the second blister strip 21/2 has been completed, and in this way sufficient time is available so as to be able to replace the "exhausted" storage roll 22/1 for a new storage roll at the delivery station 16 in question, which can then be used when the other storage roll 22/1 is exhausted.

A suitable configuration of the changeover device 68 for the implementation of these functions is explained in turn on the basis of the functions of sub-units of the changeover device, with the aid of which a person skilled in the art in precision engineering and control technology can realise the changeover device 68, so that a detailed description of structural details appears unnecessary.

The changeover device 68 consists essentially of a "Y" guide system identified overall by the reference numeral 72, which comprises two guide branches 73/1 and 73/2 associated with each of the two blister strips 21/1 and 21/2 and transporting drives 74/1 and 74/2 associated individually with each of these, and also comprises a continuing guide branch 73/3 derived from the combination of the two guide branches 73/1 and 73/2, via which the blister strip strands that can be withdrawn from the various storage rolls 22/1 and 22/2 can be transported by means of the feed drive 36 alternately to the delivery station 16.

The transporting drives 74/1 and 74/2 may be largely similar as regards their construction and the drive concept used in each case for the feed drives 36 and the further auxiliary drives 38; however, these transporting drives 74/1 and 74/2 should be able to be controlled so that they can be operated at least part of the time at a higher transporting speed than the in each case following feed drive 36 that determines the transporting speed of the in each case used blister strip in the combined guide branch 73/3, as well as in the following delivery station 16, so that the blister strip end section that has been withdrawn from the exhausted storage roll 22/1 or 22/2, and subsequent starting sections of the blister strips 21/2 or 21/1 to be threaded in, as it were "overtake" the end section of the blister strip that has reached the combined guide section 73/3, i.e. can be brought into engagement therewith, so that these blister strip strands continue one another as it were "uninterruptedly" and in the delivery station 16 a gap is avoided in the blister well 23 used to fill the medicament cassette 11.

In the embodiment chosen for the above description, the transporting drives 74/1 and 74/2 each have on the "smooth" delivery side 76 of the blister strips 21/1 and 21/2 sliding rollers 79/1 and 79/2 mounted freely rotatably on shafts 78/1 and 78/2 running parallel to the axes of rotation of the storage rolls 22/1 and 22/2, in each case arranged on sections of the changeover device 68 free of guide elements, on a frame 77 shown simply diagrammatically, the said sliding rollers extending over the whole width of the blister strips 21/1 and

21/2 pressed against them, as well as drive rollers 81/1 and 81/2 that can be driven by electric motors (not shown), which drive rollers are arranged opposite the sliding rollers 79/1 and 79/2 and can roll on an edge strip of the well sides 82/1 and 82/2 of the blister strips 21/1 and 21/2 respectively lying opposite the sliding rollers 79/1 and 79/2, which engage with the drive rollers 81/1 and 81/2 in a frictional or frictional-interlocking manner, i.e. in a substantially slip-free manner apart from elastic deformations.

In the advantageous configuration of the transporting drives 74/1 and 74/2 reproduced in FIG. 5*a*, their drive rollers 81 are designed and arranged so that they engage on only one of the two edge strips 83/1 and 83/2 of the respective blister strip 21, between which the blister wells 23 are arranged, wherein the blister strips 21 are in each case designed symmetrically with respect to their longitudinal mid-planes 84 that extend between the edge strips 83/1 and 83/2.

The guide branches 73/3 of the "Y" guide system 72 leading according to FIG. 4*a* to the feed drives 36 are, as can be seen directly from FIG. 5*b*, formed in each case by a pair of "U" profiled sections 86/1 and 86/2, which are arranged with their parallel arms 87/1 and 87/2 pointing towards one another so that the clear "horizontal" interspacing of their yoke arms 88 corresponds, apart from a play necessary for the slight displacability of the blister strips, to the width bs of the blister strips 21, these guide U-shaped profiled sections 86/1 and 86/2 surrounding the edge strips 83/1 and 83/2 of the blister strips over most of the width of the edge strips; the clear interspacing af on the well-side narrow front edges 89 of the well-side U-shaped arms 87/1 is sufficiently dimensioned so that the blister wells 23 cannot touch the guide profiled sections.

The "vertical" interspacing of the parallel profiled arms 87/1 and 87/2 of the guide U-shaped profiled sections 86/1 and 86/2 is slightly, for example by 10% to 20%, larger than the sum of the thicknesses of the guide edge strips 83/1 and 83/2 of the blister strips 21/1 and 21/2 and of the blister cover strips 91 sealing the blister wells 23 "downwardly", so that although a smooth sliding-type guidance of the blister strips 21/1 and 21/2 in the horizontal combined guide branch 73/3 of the respective "Y" guide system 72 is ensured, an overlapping of two blister strips in the region of an end section of a blister strip arranged in the delivery station region with a starting region of a blister strip "pushed from behind" is however definitely excluded.

The construction of the guide branches 73/1 and 73/2 extending between the transporting drives 74/1 and 74/2 on the one hand, and the combination point 92 of the respective "Y" guide system 72 on the other hand, is similar to that of the combined section 73/3, where instead of U-shaped profiles provided as in FIG. 5*b* to implement the guide branch 73/3 leading directly to the delivery station 16, simple angle-shaped profiles 93 (FIG. 5*c*) can be used to realise the two "convergent" guide branches 73/1 and 73/2 arranged above one another, which are secured to sides of frame metal sheets 94/1 and 94/2 facing one another, which form housing elements of a changeover device 68 designed as a function module.

What has been said regarding the construction of the "Y" guide system 72 also applies as appropriate to a "vertical" connection guide identified overall by the reference numeral 96, by means of which the blister strip 21/1 that can be withdrawn from one storage roll 22/1 is fed to the associated transporting drive 74/1 of the changeover device, as well as to the "horizontal" connection guide 97 according to FIG. 4*a*, via which the blister strip 21/2 that can be withdrawn from the second storage roll 22/2 can be fed to the associated transporting drive 74/2 of the changeover device 68.

These connection guides 96 and 97 can also conveniently be realised within the framework of the changeover device 68.

In the version of the changeover device 68 used for the above description, the connection guides 96 and 97 are equipped with end sensors 98/1 and 98/2 diagrammatically illustrated as light barriers, which emit an output signal that can be evaluated in order to control the arrangement 10 when the end of a blister strip 21/1 or 21/2 withdrawn from the respective storage roll releases a barrier light beam—which is no longer blocked off—or generates a characteristic signal to interrupt the barrier light beam when the start of a blister strip that can be withdrawn from the respective roller blocks off the barrier light beam.

These signals can be used to calibrate or check the displays of path transmitters, as explained according to the basic concept for example on the basis of FIGS. 3*a* and 3*b*.

A suitable light barrier arrangement 99 to detect the position of a blister strip may also be realised with the structure illustrated diagrammatically in FIG. 4*b*, in which the barrier light beam 101 is released when it can pass through the gap between two blister wells 23, though the blister well itself is largely cut off. By evaluating a sequence of detector output signals of this light barrier arrangement 99 in correlation with path transmitter output signals that can be obtained with an arrangement described with the aid of FIG. 3*b*, the end of the blister strip 21/1 or 21/2 can be determined very precisely, obviously taking into account the geometrical dimensions of the arrangement 10 and its delivery stations 16.

In a typical configuration of blister strips 21 reproduced in FIGS. 6*a* to 6*d*, the wells 23 that receive the medicaments are formed as one-sided, trough-shaped indentations 102 of a strip 100 consisting of a transparent plastics material. These indentations 102 are formed for example by thermoforming the thermoformable plastics material, wherein in the region of the indentations a material weakness is produced in such a way that the trough-shaped regions have a flexible, loose consistency, so that they can easily be deformed by means of the tappets 27 of the delivery cylinders 28, whereas in the remaining "flat" strip region that forms the longitudinal edge strips 46 used for the transportation and borders the openings 103 of the wells 23, they have a stiffer, flexural elastic consistency. These openings are, in the blister strip 21 prepared ready for use, covered by a cover strip identified overall by the reference numeral 104, which is tightly secured to the trough-forming, transparent plastics strips 100 after the medicaments have been added to the trough-shaped indentations.

The cover strip 104 too conveniently consists of a plastics material that is flexularally elastic in the envisaged dimensions.

According to FIG. 6*c* the cover strip 104 is narrower than the trough-forming plastics strip 100, though is broad enough for the trough openings 103 to be arranged completely within the strip width of the cover strip 104. The cover strip 104 is provided in each case in the area of its regions covering the trough openings 103, with narrow longitudinal slits 106/1 and 106/2 and transverse slits 107 running between the latter, which in the special embodiment used for the description form in the region of the respective opening 103 the H-shaped slit profile that can be seen in FIG. 6*c*, which is symmetrical with respect to the longitudinal mid-plane 106 of the blister strip 21 and in each case is also symmetrical with respect to the transverse mid-plane 109 (FIG. 6*b*) of the respective blister well 23.

The tight material securement of the cover strip 104 to the trough-forming plastics strip 100 is effected in such a way that a rigid connection is formed between these two plastics strips only in the region of the longitudinal edge strips 111/1 and 111/2 of the cover strip, as well as in the region of transverse bands 112 of the cover strip 100, which run between blister wells 23 arranged adjacent to one another in the longitudinal direction.

In this way, in each case the two rectangular wings 113/1 and 113/2 staggered with respect to one another by the transverse slit 107, which, running in a coplanar manner, cover the trough opening 103, are movable and can, if the respective ejection cylinder is actuated, open in the manner of a pair of folding doors (FIG. 6*d*) through which the respective medicament can leave and, in the case of a configuration of the arrangement as illustrated in FIG. 2*a*, can be delivered into the arranged receiving compartment of the transporting sheet 13.

In the course of the retraction of the ejection tappet 27 to its starting position, the two "door" wings 113/1 and 113/2 also return on account of their elasticity to their starting positions, in which they do not prevent the further transportation of the blister strip 21, which can also be guided in the region of the ejection cylinder into U-shaped guide elements, as has already been explained on the basis of FIG. 5*b*.

In contrast to the delivery station 16 according to FIG. 2*a*, in the delivery station 16 according to FIG. 7*a*, the details of which will now be referred to, the medicaments 122 ejected from the blister wells 23 from the blister strip 21 by means of the ejection cylinders 28/1 to 28/7 are held at an intermediate level above the transporting sheet 13 before they are delivered—preferably simultaneously—into the receiving compartments 12 of the transporting sheet 13.

This intermediate level is determined by the arrangement of a movable cover strip identified overall by the reference numeral 117, which is arranged at a vertical distance from the blister strip 21 underneath the latter and runs parallel to this immediately above the transporting sheet 13, and can be displaced transverse to the transporting direction of the sheet 13 in a transverse guide (not shown in detail), which is constructed similarly to the guide described with the aid of FIG. 5*b*.

This cover strip, with which the receiving compartments 12 of the transporting sheet 13 arranged in a line adjacent to one another at the respective delivery station 16 can be covered, has a configuration similar to the cover strip (FIG. 5*b* as well as FIGS. 6*a* to 6*d*) of the blister strip 21, with wing-shaped flaps 119/1 and 119/2 bordered by H-shaped slits, wherein the periodicity length Lp of this periodic flap structure of the cover strip 117 corresponds to that of the receiving compartments 12 of the transporting sheet 13 within a line of such compartments. A transporting drive, not shown in detail for the sake of simplicity, for the cover strips 117 is on the other hand configured so that the transporting step size corresponds to the periodicity length Lp or to a proper fraction thereof, and so that the step-by-step transportation is controlled in such a way that when the cover strip 117 stops, the transverse slit 118 between the two cover wings 119/1 and 119/2, which in the stop state each cover one of the receiving compartments 12, runs in the respective "vertical" longitudinal mid-plane 121 in which also runs the transverse slit 107 of the blister strip cover strip arranged thereabove in the delivery position of the blister strip 21.

In the embodiment used for the description the periodicity length Lp of the cover strip 117 is double the periodicity length of the blister strip 21.

In the configuration of the delivery station according to FIG. 7*a*, the medicament administration units 122 ejected from the respective wells 23 of the blister strip first of all lie "centrally" on the upper side of the cover strip 117 and are supported by the edges, arranged on both sides of the longitudinal mid-plane 121, of the swivellable wings 119/1 and 119/2 of the cover strip 117. The delivery of the medicaments 122 into the receiving compartments 12, arranged underneath the cover strip 117, of the respective transporting sheet 13 takes place in the illustrated embodiment by swivelling by 90° the hammer-shaped expulsion elements illustrated in FIG. 7*a*, which can be swivelled from a base position illustrated in the right-hand part of FIG. 7*a*, in which they are accommodated by receiving slits of a housing block 124 extending between the blister strip guide and the guide for the cover strip 117, into the expulsion position illustrated in the left-hand part of FIG. 7, in which the medicament 122 falls between the forced-apart transverse edges 125/1 and 125/2 into the respective receiving compartment, following which the respective expulsion element 123 is swivelled back again into its "vertical" base position.

For the ejection actuation of the expulsion elements 123, in the embodiment used for the description a common drive is provided that is realised by means of a double-acting pneumatic cylinder 126, by means of which a flat bar 127 on the housing block 124 can be displaced backwards and forwards. This flat bar 127 is provided with vertically running longitudinal guide holes 128, in which a driving pin 129 of the expulsion elements 123 engages in a slidable-interlocking manner in such a way that 90° swivelling movements of the expulsion elements 123, running in the direction of the double arrow 132 of FIG. 7, can be achieved with the "horizontal" forwards and backwards movements of the flat bar 128 taking place in the direction of the double arrow 132 of FIG. 7*b*.

In order to check the functioning of the delivery station 116 light barriers (FIG. 7*c*) identified overall in each case by the reference numeral 133 are provided, which are individually associated with the delivery cylinders 28/1 to 28/7, the respective optical axis 134 of the barriers running in the vertical longitudinal mid-plane 121 between the transverse edges 125/1 and 125/2 of the wing-shaped flaps 119/1 and 119/2 of the "lower" cover strip 117 and at a clear distance above the latter that corresponds to about half the diameter of the medicament 122 to be delivered in each case.

The cover strip 117 consists of an elastic material, so that the wing-shaped flaps 119/1 and 119/2, after the medicament 122 has been ejected downwardly, return again to their starting position, in which the flaps 119/1 and 119/2 are again arranged coplanar.

A suitable material may be an elastic plastics material, in which connection the cover strip 117 may in addition be metallised.

The cover strip 117 is a functional element of a device for monitoring the function as well as for quality control that is integrated as it were in the arrangement 10, and must therefore not be exposed to the danger of damage. Accordingly the cover strip is displacable—"renewable"—in such a way that the delivery station 16 is filled at least from time to time with a "new" cover strip section, wherein the cover strip is displaced in a pulsed manner by a periodicity length Lp, for example after completion of ten delivery cycles of the respective delivery station, obviously subject to the proviso that a conceivable danger due to damage of the cover strip in the delivery station region is prevented.

Filling arrangements falling within the scope of the invention may, as explained hereinbefore, be modified in various ways. Modifications that have not been illustrated include for example the following:

In the case of variously required medicaments, a plurality of delivery modules may be provided that comprise in each case a delivery station and a storage roll.

A configuration of a filling arrangement according to the invention is also possible in which a double delivery station is supplied from one blister storage roll if one storage roll is sufficient in a filling arrangement containing two filling units in order to serve both filling lines, in which in such a case the more frequently required medicaments are each supplied by their own storage roll and a delivery station associated therewith.

A convenient modification may also consist in the fact that in the configuration containing two transporting lines, the matrix lines of the cassette arrangement are associated with the times of the day, and the daily sequence as it were corresponds to the gaps of the matrix arrangement of the pairs of transporting sheets 13 to be filled in parallel. In this case the delivery station has eight ejection elements for the case where the daily subdivision is morning, midday, evening and night time, which was represented by the matrix lines in the embodiments illustrated with the aid of FIGS. 1 to 7*c*.

The invention claimed is:

1. An arrangement for filling packaging units with a plurality of medicaments, that correspond to the weekly requirements of a plurality of different patients who take these medicaments in an ordered sequence according to date and time of day corresponding to a patient-related medical prescription, in which the packaging units have receiving compartments for medicament administration units arranged in a matrix configuration of lines and columns, which medicaments are prescribed to each be taken within time spans of the respective patient identified by the arrangement of the compartments within the matrix, the arrangement including;

a) a plurality of delivery stations individually associated with the packaging units at which a line-by-line filling of all or only a proportion of selected compartments automatically takes place;

b) a longitudinal transporting device to transport the packaging units in a predetermined direction sequentially to the delivery station of the plurality of delivery stations associated individually with the various medicaments;

c) transverse conveying devices individually associated with the medicaments to effect the feed of the medicament administration units to the delivery stations;

d) a matching of the longitudinal transporting device and the transverse conveying devices to one another as regards transporting stroke and conveying capacity so that a sequential line-by-line filling of the receiving compartments can be achieved per transporting stroke of the packaging units in the column direction of the receiving compartment arrangement, and per conveying stroke of the transverse conveying devices in the line direction of the receiving compartment arrangement, the said filling taking place in each case in synchronized stoppage phases of the longitudinal transporting and transverse conveying cycles; and e) an electronic to control the delivery stations within the context of the medical prescription-oriented filling of the packaging units with medicaments, the electronic control unit structured to generate control signals from input information signals that contain information about the patients and about the contents of the packaging units which signals are continuously passed to the control unit in a sequence unambiguously associated with the patient and synchronized with the forward feed movements of the packaging units, wherein the administration units are delivered to the respective delivery stations by means of blister strips unwound from a storage roll.

2. A filling arrangement according to claim 1 in which, within a spatially defined configuration relating to the packaging units, data carriers are provided, which contain the patient-related data in machine-readable form.

3. A filling arrangement according to claim 2 in which reading stations for the data carriers of the packaging units are provided at the delivery stations.

4. A filling arrangement according to claim 3 in which the reading station provided for a delivery station, seen in the transporting direction of the packaging units, is arranged at a delivery station arranged upstream of the delivery station to be controlled.

5. A filling arrangement according to claim 1 in which the packaging units have printable areas on which label-type delivery station procedure information can be printed by printing devices associated, with individual one of the delivery stations.

6. A filling arrangement according to claim 1 in which the administration units are in the form of tablets, capsules, and pills, and are arranged equidistantly on the blister strips that are wound on the storage roll, in which transporting drive devices for the transverse conveyance of the blister strips are arranged between the storage rolls and the delivery stations, and in which the delivery stations, seen in the transporting direction of the blister strips, have ejection units arranged in succession one after the other, by which the medicaments can be ejected from the blister wells and delivered into the receiving compartments of the packaging units.

7. A filling arrangement according to claim 6 in which an interspacing Lp of ejection units adjacent to one another corresponds to an integral multiple of the interspacing Ip of adjacent blister wells of the respective blister strip.

8. A filling arrangement according to claim 6 in which the ejection units are designed as pneumatic linear cylinders.

9. A filling arrangement according to claim 8 in which piston rods projecting from respective the housing of the pneumatic cylinders are provided with tappet heads that have an approximately concave shape complementary to that of the medicaments to be ejected.

10. A filling arrangement according to claim 6 in which the blister strips have edge strips running on both sides of a strip-shaped middle region in which the blister wells are arranged, the said edge strips being engaged by the drive devices.

11. A filling arrangement according to claim 10 in which U-shaped guide elements that at least in sections surround the edge strips of the blister strips are provided for transportation guidance, the guide elements providing an interlocking guidance of the blister strips on both sides of drive devices.

12. A filling arrangement according to claim 11 in which the U-shaped guide elements have mutually parallel guide arms and the distance between the guide arms is less than double the thickness of the edge strips of the blister strips.

13. A filling arrangement according to claim 6 in which the blister strips have plastics strips forming the wells for the medicaments, as well as flexularly elastic cover strips covering the well openings, which cover strips are provided in the region of the openings with embossings and/or perforations and/or narrow slits to facilitate the ejection of the medicaments.

14. A filling arrangement according to claim 13 in which the embossings and/or slits have an H-shaped configuration, in which covering wings, staggered with respect to one another by a transverse slit and staggered with respect to the edge strips of the blister strip by longitudinal slits, form cover flaps that open and close.

15. A filling arrangement according to claim 6 in which a guide for a movable cover strip is arranged at a vertical distance (h) from a blister strip guide, at a level running parallel thereto between the blister strips and the transporting guide for the packaging unit, which cover strip is provided with embossings, perforations or slits facilitating the release of passage openings, as well as with a device for actuating the opening of cover flaps bordered by the embossings, perforations and/or slits.

16. A filling arrangement according to claim 15 in which the cover strip arranged at the intermediate level has the same periodicity length Lp as the blister strip, and is independently further transported per delivery cycle that takes place at the respective delivery station, after completion of the cycle, by a defined stretch, corresponding to the periodicity length Lp.

17. A filling arrangement according to claim 15 in which L-shaped or T-shaped release elements that can swivel by at least 90° are provided in a housing block, the release elements able to be swivelled from a base position in which vertical passage channels of the housing block that extend between the blister strip and the guide for the cover strip are released, into a position in which these channels are blocked and the medicaments are delivered into the compartments of the respective packaging unit arranged underneath the cover strip.

18. A filling arrangement according to claim 17 in which a device is provided for a common opening actuation of the release elements.

19. A filling arrangement according to claim 6 in which drive for the transverse conveyance of the blister strip comprises pair of roller which are supported on at least one of the edge strip of the blister strip in a manner engaging with drive rollers and sliding rollers on the respective edge strip, and by force closure and/or self-closure effect the conversion of drive force into forward movement.

20. A filling arrangement according to claim 19 in which drive elements are provided that include toothed pinions with smooth curved teeth, which on account of an elasticity of the blister material engage in an interlocking manner.

21. A filling arrangement according to claim 6 in which, in order to determine the path of the blister strips, incremental path transmitters are provided, which count successively covered path sections of equal length.

22. A filling arrangement according to claim 6 in which position transmitters detecting edge markings of the blister strips are provided, that outline a defined position of the respective blister strip.

23. A filling arrangement according to claim 21 in which cutting or stamping devices for producing the edge markings are provided, which are arranged at a defined distance from the delivery station proximate the blister guide devices.

24. A filling arrangement according to claim 22 in which, seen in the transporting direction of the blister strips, in each case at least one marking device is provided on a first side of the delivery station, and at least one marking device is arranged on a second side of the delivery station.

25. A filling arrangement according to claim 24 in which, seen in the transporting direction of the respective blister strip, a cutting station for separating the emptied end section of the blister strip is arranged on a far side of the delivery station.

26. A filling arrangement according to claim 1 in which sensor devices are provided that check whether medicaments are present, and detectors are provided that recognise that medicaments have been delivered.

27. A filling arrangement according to claim 26 in which detection of medicaments in the respective delivery station takes place at an intermediate level, which is marked by the arrangement of a transportable cover strip, which covers in a controllably releasable manner the receiving compartments of the respective packaging units.

28. A filling arrangement according to claim 26 in which, seen in the transporting direction of the blister strip, sensors and/or detectors recognising the presence of medicaments in the blister wells are provided on a near side and a far side of the delivery stations.

29. Filling arrangement according to claim 28 in which the sensors and/or the the detectors are formed as light barriers.

30. A filling arrangement according to claim 1 in which at least two delivery stations are provided for at least one of the medicaments.

31. A filling arrangement according to claim 30 in which a plurality of delivery stations provided for the same medicament are arranged immediately adjacent to one another.

32. A filling arrangement according to claim 1 in which two parallel transporting systems are provided for packaging units, in which, for a first type of medicament, two delivery stations associated with the individual systems are arranged next to one another and are supplied by a common transverse conveying device.

33. A filling arrangement according to claim 1 in which a longitudinal transportation of the packaging units takes place in groups, in which the packaging units making up a group are moved with the same transporting speed or with the same step sizes, though these speeds or step sizes may be different, and free buffer zones are provided between successive groups of packaging units, which permit the relative movement of the groups adjacent to one another.

34. A filling arrangement according to claim 1 in which the packaging units provided for accommodating the medicaments each have a thermoformed part forming the receiving compartments, which part is fabricated by a thermoforming station forming a first workstation of a transporting stretch of the filling arrangement and can be transported from there to the delivery stations of the arrangement.

* * * * *

UNITED STATES PATENT AND TRADEMARK OFFICE

CERTIFICATE OF CORRECTION

PATENT NO. : 7,637,079 B2
APPLICATION NO. : 11/568303
DATED : December 29, 2009
INVENTOR(S) : Hans Klingel et al.

It is certified that error appears in the above-identified patent and that said Letters Patent is hereby corrected as shown below:

Column 17, line 34 Claim 1, the word "including:" should read -- including; --;
Column 17, line 58 Claim 1, the word "electronic" should read -- electronic control unit --;
Column 17, line 64 Claim 1, the word "units" should read -- units, --;
Column 18, line 19 Claim 5, the word "one" should read -- ones --;
Column 18, line 40 Claim 9, the word "the housing" should read -- housings --;
Column 19, line 22 Claim 17, the word "position" should read -- position, --;
Column 19, line 33 Claim 19, the word "drive" should read -- drives --;
Column 19, line 33 Claim 19, the word "strip" should read -- strips --;
Column 19, line 34 Claim 19, the word "pair" should read -- pairs --;
Column 19, line 34 Claim 19, the word "roller" should read -- rollers --;
Column 19, line 35 Claim 19, the word "strip" should read -- strips --;
Column 20, line 26 Claim 28, the word "Filling" should read -- A filling --;
Column 20, line 27 Claim 29, the words "the the" should read -- the --.

Signed and Sealed this

Sixteenth Day of March, 2010

David J. Kappos

David J. Kappos
*Director of the United States Patent and Trademark Office*